US008333612B2

(12) United States Patent
Natoli

(10) Patent No.: US 8,333,612 B2
(45) Date of Patent: Dec. 18, 2012

(54) CONNECTOR CONTACT FOR TUBULAR CENTER CONDUCTOR

(75) Inventor: Chris Natoli, Fulton, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 65 days.

(21) Appl. No.: 13/092,237

(22) Filed: Apr. 22, 2011

(65) Prior Publication Data

US 2012/0270438 A1 Oct. 25, 2012

(51) Int. Cl.
*H01R 9/05* (2006.01)

(52) U.S. Cl. ..... 439/578

(58) Field of Classification Search ..... 439/578–585, 439/246–248

See application file for complete search history.

(56) References Cited

U.S. PATENT DOCUMENTS 8,096,830 B2 * 1/2012 Rodrigues ..... 439/584
8,109,786 B2 * 2/2012 Lee et al. ..... 439/578
8,142,223 B2 * 3/2012 Holliday ..... 439/578
8,172,609 B2 * 5/2012 Hsia ..... 439/578
8,215,985 B2 * 7/2012 Amidon et al. ..... 439/578

* cited by examiner

*Primary Examiner* — Khiem Nguyen
(74) *Attorney, Agent, or Firm* — Schmeiser, Olsen & Watts, LLP

(57) ABSTRACT

A contact assembly for connecting a cable connector to a tubular center conductor of a coaxial cable includes a contact pin, a core insert, and a guided insert. The contact pin includes a proximal end, an opposing distal end, and an intermediate segment therebetween. The contact pin defines a first internal cavity on the proximal end having an inner diameter. The contact pin further includes a central bore extending from the first internal cavity into the intermediate segment. The core insert includes a proximal end, an opposing distal end, and a support section therebetween. The support section includes an axial section having a diameter greater than the distal end, and the distal end is configured for coupling with the central bore of the contact pin. The guided insert includes a body having a proximal end, an opposing distal end, and defines a central cavity at least on the distal end. The central cavity has an inner diameter smaller than the diameter of the core insert support section.

17 Claims, 5 Drawing Sheets

CONNECTOR CONTACT FOR TUBULAR CENTER CONDUCTOR

FIELD OF THE INVENTION

This invention relates generally to the field of coaxial cable connectors and more particularly to a contact assembly for use in a connector to connect coaxial cables having tubular center conductors.

BACKGROUND OF THE INVENTION

Some coaxial cables, typically referred to as hard line coaxial cables, include a center conductor constructed of a smooth-walled or corrugated, metallic (e.g., copper, aluminum, steel, copper clad aluminum, etc.) tube, the material selection depending on weight, cost, flexibility, etc. Such a center conductor is referred to herein as a tubular center conductor.

A tubular center conductor typically includes a hollow internal portion. Electrical connections to the tubular center conductor can be made within the hollow internal portion, because the electromagnetic signals within the coaxial cable pass using mainly the outer diametral portions of the tubular center conductor. Accordingly, coaxial cable connectors that are designed to work with such hard line coaxial cables typically include contacts that are extended within the hollow internal portion of the tubular center conductor. Such coaxial cable connectors are referred to herein as hard line connectors.

The contacts used in many of these hard line connectors are held against the hollow internal portion by a support arm. Each of these contacts used in hard line connectors is located at or near an end of the support arm toward the end of the contact pin or contact assembly. In many of these contact pins or contact assemblies, the support arm is cantilevered from a mounting position within the hard line connector. Then, during installation, each of these support arms, along with its respective contact, is deflected to a smaller effective diameter during installation into the hollow internal portion. The amount of deflection may vary greatly to accommodate a range of possible variations occurring within a single tubular center conductor or between different tubular center conductors. These variations may be accounted by manufacturing tolerances, design differences, and shape irregularities. The variations can be larger than a limit of elastic deflection characterizing the support arms. The support arms can be plastically deformed, which can impair electrical contact between the tubular center conductor and the contact pin or contact assembly.

Any plastic deformation of the support arms may result in a poor electrical connection between the contacts and the hollow internal portion of the tubular center conductor. An amount of pressure applied by each contact is determined by the amount of elastic deflection between a free-state position of each support arm and an installed-state position of the support arm. Accordingly, any amount of plastic deformation of the support arm during installation will result in a reduced free-state position and, therefore, a reduced pressure applied by each contact.

Previous attempts have been made to increase the amount of elastic deflection available to each support arm by reducing the cross sectional thickness of the support arm. This reduction in the cross sectional thickness naturally allows for greater elastic deflections before the support arm becomes plastically deformed. It is important to note, however, that this reduction in the cross sectional thickness correspondingly reduces the amount of pressure applied to the contact. Any reduction in, or elimination of the amount of pressure applied to the contact may reduce the quality of the connection and degrade the signal.

Other attempts have been made to increase the amount of pressure applied to the contact by various methods, such as increasing the cross sectional thickness of each support arm and using more resilient materials. This increase in the amount of pressure comes with a strong disadvantage of increasing an amount of moving force required to install the contact assembly into the hollow internal portion of the tubular center conductor. This increased installation force may result in damaged contacts and/or an incomplete installation. Both of these outcomes may reduce the quality of the connection and degrade the signal.

In some of the contacts used in hard line connectors, plastic deformation is overcome by using a plastic or ceramic insert that is inserted into the contact pin. The insert has a ramped portion, which pushes the support arms of the contact pin outward against the hollow internal surface of the tubular center conductor. In this type of contact assembly, the support arms are moved outward rather than being deflected inward. More force can be applied to improve or increase the likelihood of a good connection between the contacts and the tubular center conductor.

However, in each case, each contact is likely to make only a point contact between each contact and the hollow internal surface of the tubular center conductor. A point contact can negatively affect electrical performance and integrity, while a greater area of contact can improve electrical performance and integrity. Whether deflected radially inward or radially outward, each support arm is forced from a single location along the length of the support arm, either at the contact point between the tubular center conductor and the contact, or at the contact point between the ramped portion on the insert and the support arm. Each support arm is deflected either radially inward or radially outward by the force at the one location during contact with the tubular center conductor so that each support arm is angled non-parallel with respect to the inner surface of the tubular center conductor. Contact with the tubular center conductor is made only at one contact surface. At this one contact surface, the contact made can be very small, or at a point because with the support arm angled non-parallel with the tubular center conductor, the contact surface can also be angled non-parallel, so the contact surface does not rest flush and/or conform to the surface of the tubular center conductor.

Furthermore, due to the size variations and the shape irregularities of the tubular center conductors, if the surface of the contact can be made to rest or be pressed flush to the surface of one tubular center conductor, the contact will not rest or be pressed flush with the surface of other tubular center conductors having variations in size or shape. In some cases, because of irregularities in the smoothness of the surface of the contacts, and because of irregularities in the smoothness of the interior surface of the tubular center conductor, the surface of the contacts and the interior surface of the tubular center conductor do not conform, and make contact at a single point.

Furthermore, with a helical or corrugated tubular center conductor, the potential points of contact between the contact and the center conductor around the circumference of the contact can vary axially from a plane perpendicular to the axis of the contact, which can be more of a problem when only a point contact is made, or when contact is made or pressure is applied to make contact at one axial location. While the helical corrugations provide structural stability during bending of the coaxial cable and the tubular center conductor, the helical corrugations also provide a non-regular surface against which the contacts make contact. A point contact is likely to occur at a helical corrugation because the corrugation winds axially away from the point of pressure rather than extending circumferentially at the same axial location. Otherwise, multiple point contacts might be made that vary axially traveling around the inner circumference of the tubular center conductor. For instance, one contact might contact the tubular center conductor at a first end of the respective contact, while another contact might contact the tubular center conductor at a second end of the respective contact opposite the first end in the axial direction. The contact between the contact and the tubular center conductor can weaken or fail traveling axially away from the area where pressure is applied between the contact and the tubular center conductor, leaving very little area of contact between the contact and the tubular center conductor.

BRIEF DESCRIPTION OF THE INVENTION

In one embodiment, a contact assembly for connecting a cable connector to a tubular center conductor of a coaxial cable includes a contact pin, a core insert, and a guided insert. The contact pin includes a proximal end, an opposing distal end, and an intermediate segment therebetween. The contact pin defines a first internal cavity on the proximal end having an inner diameter. The contact pin further includes a central bore extending from the first internal cavity into the intermediate segment. The core insert includes a proximal end, an opposing distal end, and a support section therebetween. The support section includes an axial section having a diameter greater than the distal end, and the distal end is configured for coupling with the central bore of the contact pin. The guided insert includes a body having a proximal end, an opposing distal end, and defines a central cavity at least on the distal end. The central cavity has an inner diameter smaller than the diameter of the core insert support section.

In another embodiment, a connector for connecting to a coaxial cable is provided. The coaxial cable includes a tubular center conductor, a dielectric layer disposed concentrically around the center conductor, an outer conductor disposed concentrically around the dielectric layer, and an outer jacket disposed concentrically around the outer conductor. The connector includes a body configured to mate with a port connector, an insulator ring concentrically disposed within the body, and an electrically conductive contact pin disposed within the insulator ring. The contact pin includes a proximal end, an opposing distal end, and an intermediate segment therebetween. The proximal end includes circumferentially spaced contact fingers having a tip and a base. The contact fingers define a plurality of contact slots therebetween and further define a first internal cavity having an inner diameter. The contact pin further includes a central bore extending from the first internal cavity into the intermediate segment.

The connector further includes a core insert comprising a proximal end, an opposing distal end coupled with the central bore of the contact pin, and a support section between the proximal and distal ends. The support section includes an axial section having a diameter greater than the distal end.

The connector further includes a guided insert comprising a body having a proximal end, an opposing distal end, and defining a central cavity at least on the distal end. The central cavity has an inner diameter that is smaller than the diameter of the core insert support section. The distal end includes a plurality of insert fingers defining insert slots therebetween, and an inner surface of the insert fingers is in contact with the support section of the core insert. An outer surface of the insert fingers is in contact with the an inner surface of the contact pin fingers.

The connector further includes a cap sealingly coupled to the body and the coaxial cable jacket. The contact pin fingers are in electrical contact with an inner surface of the tubular center conductor at a plurality of axial locations.

In yet another embodiment, a method for installing a coaxial cable to a port connector is provided. The method includes the steps of providing a coaxial cable comprising a tubular center conductor, a dielectric layer disposed concentrically around the center conductor, an outer conductor disposed concentrically around the dielectric layer, and an outer jacket disposed concentrically around the outer conductor.

The method further includes the step of providing a contact assembly including a contact pin, a core insert, and a guided insert. The contact pin includes circumferentially spaced contact fingers defining a first internal cavity, and further includes a central bore extending from the first internal cavity into an intermediate segment. The core insert has a support section including a raised outer diameter. The guided insert includes a body having a proximal end, an opposing distal end, and defines a central cavity. The central cavity has an inner diameter smaller than the diameter of the core insert support section, and the distal end includes a plurality of insert fingers.

The method further includes the step of assembling the contact assembly to a first position of clearance by inserting a distal end of the core insert into the central bore of the contact pin and inserting the guided insert fingers into the first internal cavity of the contact pin. The contact assembly is advanced to a second position of interference by advancing the coaxial cable towards the port connector, wherein the contact pin fingers contact an inner surface of the tubular center conductor at a plurality of axial locations.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION OF THE INVENTION

Throughout the following course of discussion, several terms such as "distal", "proximal", "forward", and "rearward" are used in an effort to provide a suitable frame of reference with regard to the accompanying drawings. In general, "proximal" is toward the coaxial cable, "distal" is towards the mating connector, "forward" motion is from the coaxial cable towards the mating connector, and "rearward" motion is from the mating connector towards the coaxial cable. These terms are not intended, however, to be overly limiting of the present invention as claimed, except where so specifically indicated herein.

Figure 1:
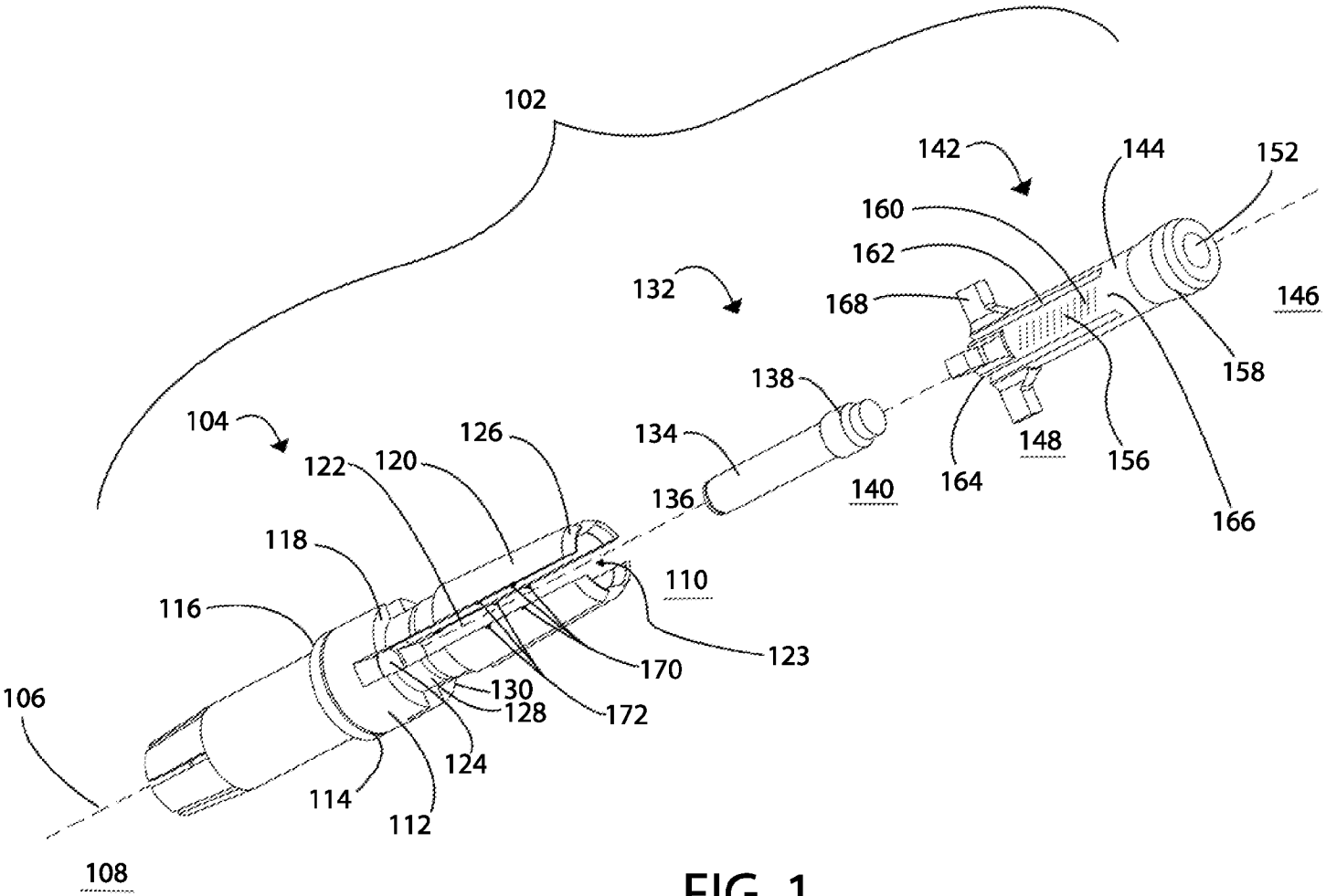
FIG. 1 shows an exploded perspective view of a contact assembly in a first position of clearance, according to one embodiment of the invention.

FIG. 1 shows an exploded perspective view of a contact assembly 102, according to one embodiment of the invention. The contact assembly 102 comprises a contact pin, a core insert, and a guided insert. The contact pin 104, which is generally cylindrical in shape along a common axis 106, includes a distal end 108 aligned towards a mating port connector (not shown), an opposing proximal end 110, and an intermediate segment 112 between the proximate and distal ends. In the illustrated embodiment, the intermediate segment 112 has a larger outer diameter than the distal and proximal ends 108, 110 and includes an annular groove 114. The contact pin 104 can have a first shoulder 116 at the transition from the distal end 108 to the intermediate segment 112, and a second shoulder 118 at the transition from the proximal end 110 to the intermediate segment 112. The proximal end 110 of the contact pin 104 includes contact fingers 120 and contact slots 122 between each contact finger. The contact fingers 120 define a first internal cavity 123 having an inner diameter. A central bore 124 extends from the first internal cavity 123 along the common axis 106 into the intermediate segment 112.

The contact fingers 120 and the contact slots 122 can vary in number. In the illustrated embodiment there are four. Each contact finger 120 can have a contact finger tip 126 and a contact finger base 128. Each contact finger 120 joins the intermediate segment 112 at the contact finger base 128. In one embodiment, each contact finger 120 narrows in width at the base 128 for increased flexibility. The contact finger base 128 may also include an annular slot 130. The depth of each annular slot 130 may yield a radial distance that is less than the outer diameter of each contact finger 120 towards the tip contact finger tip 126. The tip 126 can be tapered, rounded, chamfered, or the like. The contact pin 104 can be comprised of a conductive material such as, but not limited to, brass.

The core insert 132 can be generally cylindrical and includes an insert body 134 having a first diameter on the distal end 136 sized for engagement with the central bore 124 of the contact pin 104, as will be explained in detail below. The core insert 132 further includes a second, larger diameter on a support section 138, the function of which will be explained below. In the illustrated embodiment, the support section 138 is located toward a proximal end 140 of the core insert 132. The axial length of the support section 138 is not critical, so long as there is a sufficient length of raised material to carry out the support function. In some embodiments, such as that illustrated, the support section 138 transitions at the proximal end 140 back to the diameter of the insert body 134. The support section 138 is also illustrated as a solid ring, but may be segmented as long as the raised portion support or are otherwise aligned with the insert fingers of the guided insert. The distal end 136 and the proximal end 140 of the core insert 132 can be tapered, rounded, or chamfered to assist insertion of the core insert into either the contact pin 104 or the guided insert 142. Similarly, the transition to the larger diameter support section 138 on the proximal end 140 may be conical (e.g., tapered), rounded, or chamfered to assist in engagement. The core insert 132 can be comprised of plastic, ceramic, or another electrically nonconductive material.

The guided insert 142 includes a generally tubular body 144 having a proximal end 146 and a distal end 148. In one embodiment, the guided insert 142 may be comprised of plastic, ceramic, or another electrically nonconductive material. An inner diameter 150 (FIG. 2) of the body 144 defines a central cavity 152 disposed along the common axis 106. An outer diameter 154 (FIG. 2) of the body 144 at the distal end 148 defines an engagement region 156. The proximal end 146 of the body 144 may include a raised outer diameter 158 having a shallow-angle conical transition from the diameter of the insert body 144. The raised outer diameter 158 may be continuous or broken, as long as its function is maintained. The guided insert 142 further includes a plurality of longitudinal insert fingers 160 spaced circumferentially around the distal end 148 of the body 144, the fingers defining insert slots 162 therebetween.

The insert fingers 160 and the insert slots 162 can vary in number. The number of insert fingers 160 and insert slots 162 can correspond to the number of contact fingers 120 and contact slots 122 for the contact pin 104. Each insert finger 160 includes an insert finger tip 164 and an insert finger base 166. Each insert finger 160 is integrally or otherwise connected to the guided insert 142 at the insert finger base 166. Each insert finger tip 164 can be tapered, rounded, chamfered, or the like. Each insert finger 160 may include a guide tab 168 extending radially outward from the insert finger 160. In some embodiments, each guide tab 168 is positioned at the insert finger tip 164. The guide tab 168 on the guided insert 142 is sized to fit within the contact slot 122 on the contact pin 104. In one embodiment, the guided insert finger 160 may be sized wider than the contact slot 122 on the contact pin 104. In this manner, each insert finger 160 of the guided insert 142 will cover the contact slot 122 of the contact pin 104 and partially cover the two opposing (adjacent) contact fingers 120.

Figure 2:
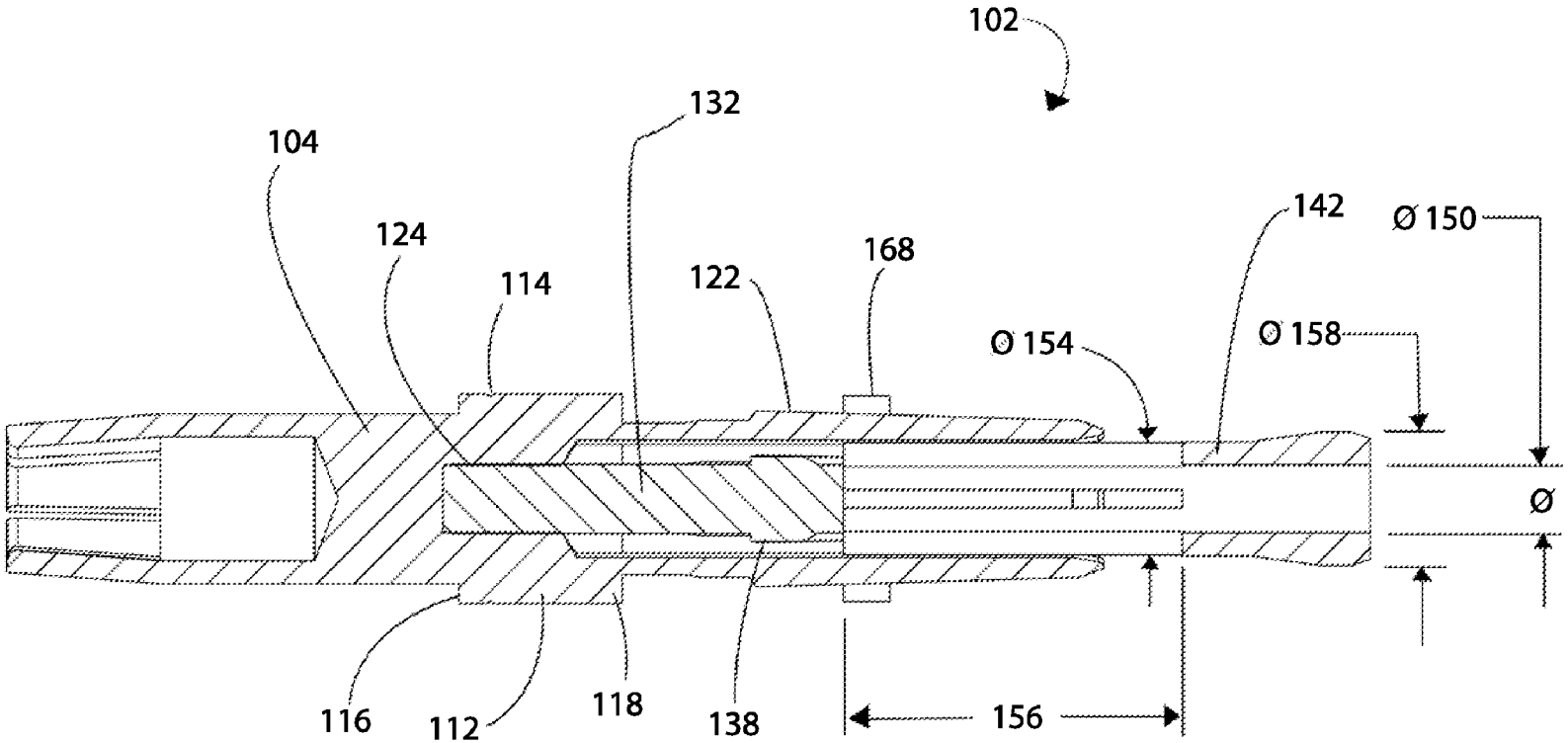
FIG. 2 shows a cross sectional view of the contact assembly of FIG. 1, in a first position of clearance.

FIG. 2 shows a cross sectional view of a contact assembly 102, according to the embodiment of FIG. 1, in a first position of clearance. In the first position of clearance, the core insert 132 is inserted into the central bore 124 of the contact pin 104. The core insert 132 can be inserted fully into the central bore 124 of the contact pin 104, and there can be an interference fit to positively retain the core insert in place to reduce or prevent the chance of the core insert from being unintentionally loosened or removed from the central bore. The retention can also hold the core insert 132 rigidly when it engages the guided insert 142 in the second position of interference. The rounded, chamfered, or tapered end of the core insert 132 eases the insertion of the core insert 132 into the central bore 124.

In the first position of clearance, the guided insert 142 is inserted into the contact pin 104 and held relatively loosely in the contact pin. Each guide tab 168 aligns with a contact slot 122. The guided insert 142 can be approximately axially aligned with the core insert 132, but be inserted short of overlapping any portion of the core insert. Alternatively, the guided insert 142 can extend loosely over a length of the core insert 132 so the support section 138 does not press the insert fingers 160 radially outward to deflect the insert fingers and the contact fingers 120. The internal and external edges at the inserted end of the guided insert 142 can be tapered, rounded, or chamfered to ease the insertion of the guided insert 142 into the contact pin 104 and over the core insert 132.

The guided insert 142 can be held in the loose first position of clearance by a retainer that can prevent or reduce the chance of the guided insert being unintentionally removed from the contact pin 104 and/or that can retain the guided insert in the first position of clearance until it is desired to move the guided insert into a second position of interference. The retaining force of the retainer can be overcome with a force that is small relative to the force required to move the guided insert 142 into the second position of interference. The retainer can be positioned on the contact pin 104, on the guided insert 142, on the core insert 132, on both the contact pin 104 and the guided insert 142, and/or on both the guided insert 142 and the core insert 132. By way of example, referring back to FIG. 1, the retainer can be a first nub 170 and a second nub 172 on one or more of the contact sleeves 120, wherein each nub 170, 172 extends into one of the contact slots 122. During assembly into the first position of clearance, one or more guide tabs 168 can be forced past the first nub 170, and the first nub can prevent or hinder the guided insert 142 from being unintentionally removed from the first position of clearance in the contact pin 104. The second nub 172 can similarly prevent or hinder the guided insert 142 from being unintentionally moved from the first position of clearance to the second position of interference with the contact pin 104 and the core insert 132. The retainer can be embodied in numerous other alternatives, as would be known to one skilled in the art. In one instance, one or more of the nubs 170, 172 can be a ramped shoulder, with a perpendicular face to provide stronger retention. A nub might also mate with a corresponding groove or notch. Another example includes a mild adhesive.

Figure 3:
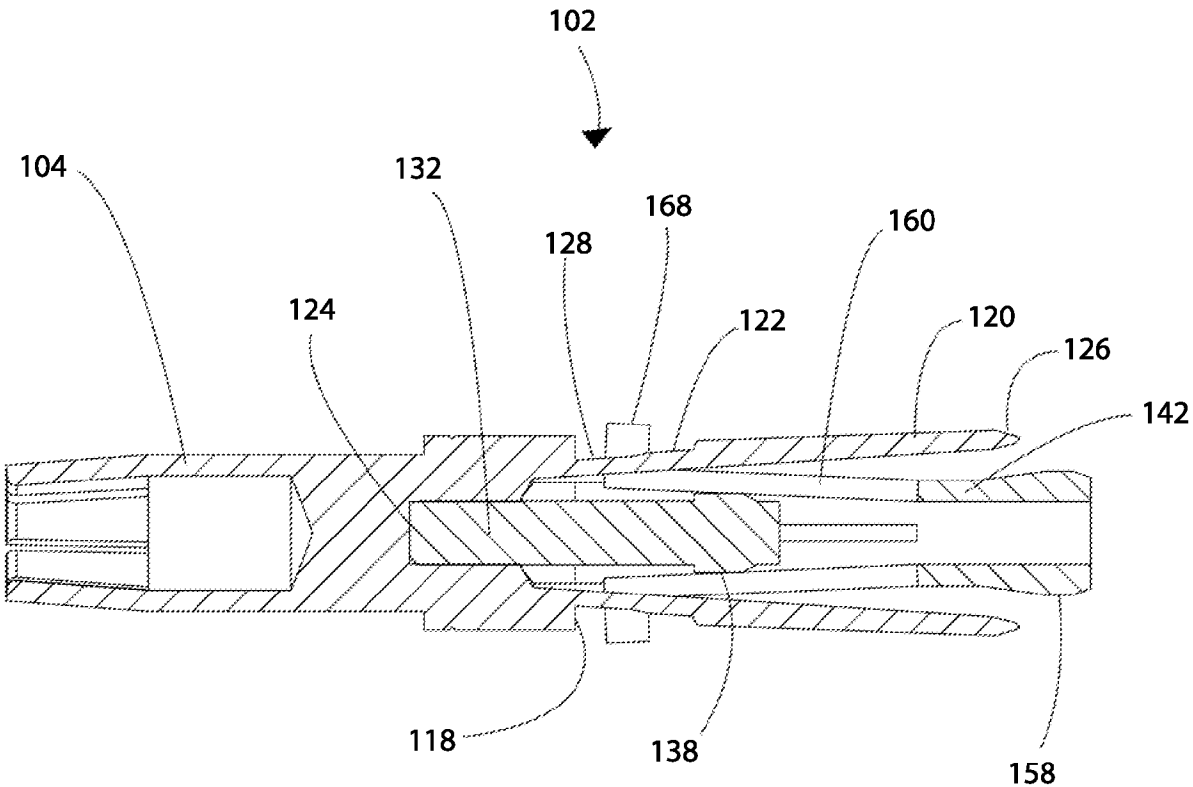
FIG. 3 shows a cross sectional view of the contact assembly of FIG. 1, in a second position of interference.

FIG. 3 shows a cross sectional view of a contact assembly 102, according to the embodiment of FIG. 1, in a second position of interference. In the second position of interference, the core insert 132 is inserted fully into the central bore 124 of the contact pin 104. When fully inserted, the depth of the central bore 124 can properly position the core insert 132. The support section 138 can be positioned more toward the contact finger base 128 than the contact finger tip 126. There can be an interference fit between the core insert 132 and the central bore 124 to retain the core insert 132. The retention can reduce or prevent the core insert 132 from unintentionally loosening from the central bore 124. The retention can also hold the core insert 132 rigidly during engagement with the guided insert 142.

In the second position of interference, the guided insert 142 is inserted fully into the contact pin 104 and concentrically over the core insert 132. Each guide tab 168 can slide into one of the contact slots 122 until the contact assembly 102 reaches the second position of interference and/or until the guide tabs 168 contact the second shoulder 118 of the contact pin 104. The insert fingers 160 are pushed onto the support section 138 of the core insert 132. The outer diameter of the support section 138 is sized greater than the guide inner diameter 150. In this manner, the support section 138 engages the insert fingers 160 and ramps the insert fingers radially outward to make contact with the inner surface of the contact fingers 120 at or near each contact finger base 132. The radially outward deflection of the insert fingers 160 subsequently deflects the contact fingers 120 radially outwardly, with contact pressure at the contact finger base 128.

The contact pressure and deflection at or near the contact finger base 128 cantilevers each contact finger 120 radially outward. The raised outer diameter 158 of the guided insert 142 is inserted to a position at or near the contact finger tip 126. If not assembled into a tubular center conductor, and with no external forces acting radially inward, each contact finger tip 126 can be deflected to a greater diameter than the outer diameter of the raised outer diameter 158 so that there is clearance between the contact finger tip 126 and the raised outer diameter 158. If the contact finger tip 126 is not deflected to a diameter greater than the outer diameter of the raised outer diameter 158, and/or an external force limits the outwardly radial deflection of the contact fingers 120 at the contact finger tip 126 so that the contact finger tip 126 are within the outer diameter of the second ramped portion (e.g. by the insertion of the contact assembly 102 into a tubular center conductor), then the contact finger tip 126 and the raised outer diameter 158 slide together, pushing the contact finger tip 126 radially outward.

Figure 4:
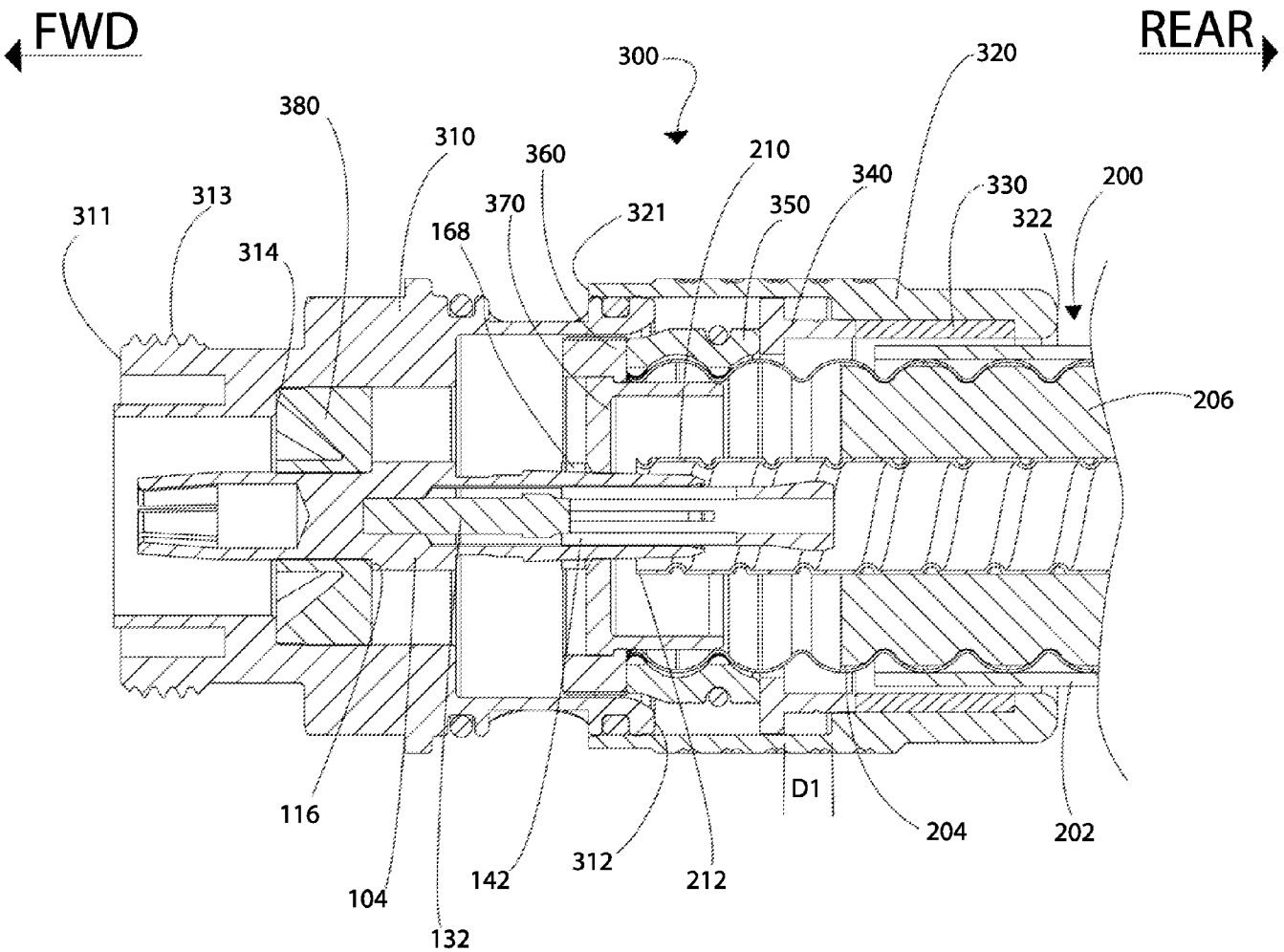
FIG. 4 shows a cross section of a contact assembly according to another embodiment of the invention.

FIG. 4 shows a cross section of the contact assembly 102 assembled with a hard line connector assembly 300 positioned to be connected and secured to a coaxial cable 200 with a tubular center conductor 210, the contact assembly 102 being in a first position of clearance, according to one embodiment of the invention.

The connector assembly 300 illustrated in FIG. 4 comprises a body 310 and a cap 320. The body 310 is positioned forward of the cap 320, and the cap 320 is positioned rearward of the body 310, with a forward end 321 of the cap 320 concentrically disposed over a rearward end 312 of the body 310. A forward end 311 of the body 310 can connect to a mating connector, such as by screwing with threads 313. The rearward end 322 of the cap 320 can allow the coaxial cable 200 to enter into the cap 320 so that the cap 320 is concentrically disposed over the coaxial cable 200.

Concentrically disposed inside the cap 320, from the rearward end 322 to the forward end 321, are a seal 330, a clamp ring 340, a clamp 350, and a mandrel ring 360. Engaged with the mandrel ring 360, and concentrically disposed within the mandrel ring 360 and the clamp 350, is a mandrel 370. The mandrel 370, the mandrel ring 360, and the clamp 350 can also be partly or fully concentrically disposed within the body 310, instead of, or in addition to being concentrically disposed partly or fully within the cap 320. An insulator 380 is concentrically disposed within the body 310. The contact assembly 102 is positioned between and extended through the insulator 380 and the mandrel 360. The first shoulder 116 of the contact assembly 102 abuts the insulator 380 and the insulator 380 abuts a third shoulder 314 extending radially inward from the inner surface of the body 310 so that the first insulator 380 and the contact assembly 102 are prevented from moving forward toward the forward end 311 of the body 310.

The coaxial cable 200 can be inserted into the connector assembly 300 through the rearward end 322 of the cap 320. A portion of an outer insulating layer 202 can be removed to expose the outer surface of an outer conductor 204, and a portion of a dielectric layer 206 between the tubular center conductor 210 and the outer conductor 204 can be removed. The coaxial cable 200 can extend through the seal 330, the clamp ring 340, and the clamp 350. The inside surface of the clamp 350 can be corrugated, or can have a shape otherwise congruent with the outer conductor 204, so that the clamp 350 can mate and/or conform with the outer conductor 204 to strengthen the clamping action of the clamp 350 on the coaxial cable 200. The portion of the dielectric layer 206 that was removed allows space for the outer conductor 204 to extend concentrically over the mandrel 370. The tubular center conductor 210 is extended so that the tubular center conductor 210 is concentrically disposed over the contact assembly 102.

In the first position of clearance, the guided insert 142 is held relatively loosely between the core insert 132 and the contact pin 104 so that relatively little or no force exists between the contact fingers 120 and the insert fingers 160, and so that relatively little or no force exists between the insert fingers 160 and the core insert 132, as compared to the force between the insert fingers 160 and both the core insert 132 and the contact fingers 120 in the second position of interference. The contact assembly 102, in the first position of interference, can slide into and out of a tubular center conductor 210 of a coaxial cable 200 with a relatively low moving force. The relatively low moving force will occur if/when the contact fingers 120 and the insert fingers 160 are pressed, even lightly, inside the tubular center conductor 210 during assembly. It should be noted, that this relatively low moving force includes the possibility of a very low or no moving force being required to insert the contact assembly 102 if/when the contact fingers 120 of the contact pin 104 do not touch the tubular center conductor 210. For example, with this relatively low moving force, the contact assembly 102 can be slid into the hollow internal portion of the tubular center conductor 210 with less force than would be required if/when the contact assembly 102 is in the second position of interference.

Figure 5:
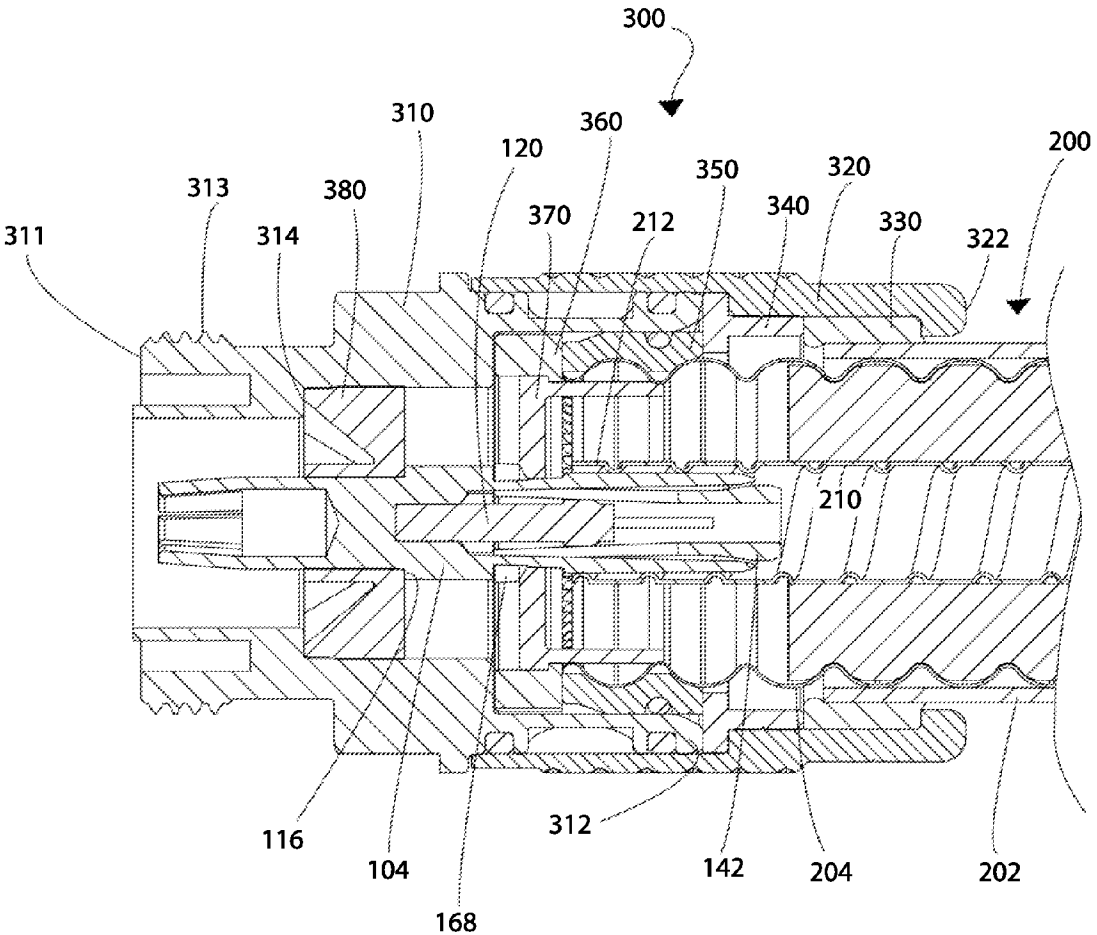
FIG. 5 shows a cross section of a contact assembly according to yet another embodiment of the invention.

FIG. 5 shows a cross section of the contact assembly 102 assembled with the hard line connector assembly 300 connected and secured to a coaxial cable 200, the contact assembly being in the second position of interference, according to one embodiment of the invention. The contact assembly 102 can be moved from the first position of clearance to the second position of interference by securing the coaxial cable 200 inside the connector assembly 300. To secure the coaxial cable 200 inside the connector assembly 300, the cap 320 is moved axially forward toward the forward end 311 of the body 310 and/or the body 310 is moved axially rearward toward the rearward end 322 of the cap 320. When the cap 320 is moved forward relative to the body 310, the seal 330 is compressed as the cap 320 moves through distance D1 (FIG. 4). When the cap 320 makes contact with the clamp ring 340, no further compression of the seal 330 occurs and the cap 320 drives the clamp ring 340 forward relative to the body 310. The clamp ring 340, in turn, compresses the clamp 350, and drives the clamp 350 forward into, and/or farther into the body 310. The clamp 350 has an outer diameter greater than the inner diameter of the rearward end 312 of the body 310, which causes an interference fit between the clamp 350 and the body 310. The interference fit provides a retention force between the clamp 350 and the body 310. The retention force may also be created or enhanced by other known methods, such as an adhesive, interlocking mechanical components, etc.

The clamp 350 is also compressed radially inward, providing a clamping force on the outer conductor 204 of the coaxial cable 200. When the clamp 350 is driven forward relative to the body 310, the clamp 350 moves the coaxial cable 200 forward relative to the body 310 as well.

Additionally, the clamp 350 drives the mandrel ring 360 forward. The mandrel ring 360 interlocks mechanically with the mandrel 370, so that the mandrel ring 360 imposes a forward force on the mandrel 370, driving and/or pulling the mandrel 370 forward. The mandrel 370, in turn, abuts on the rearward side of the guide tabs 168, and through this contact with the guide tabs 168, the mandrel 370 drives the guided insert 142 forward in relation to the body 310, the contact pin 104, and the core insert 132, which are immovable in the forward direction due to contact at shoulders 116 and 314. Thus, the tubular center conductor 210 can be driven forward in relation to the body 310, the contact pin 104, and the core insert 142 the same distance, at the same rate, and at the same time as the guided insert 142, in order to secure the coaxial cable 200 in the connector assembly 300, and move the contact assembly 102 from a first position of clearance into a second position of interference to establish electrical contact between the connector assembly 300 and the tubular center conductor 210.

As explained above with reference to FIG. 3, when the guided insert 142 moves forward toward the forward end 311 of the connector body 310, between the core insert 132 and the contact pin 104, the insert fingers 160 are pushed onto the support section 138 of the core insert 132, which deflects the insert fingers 160 radially outward to make contact with the inner surface of the contact fingers 120 at or near each contact finger base 128, which in turn deflects the contact fingers 120, with contact pressure at the contact finger base 128. The contact pressure and deflection at or near the contact finger base 128 cantilevers each contact finger 120 radially outward. Inside the tubular center conductor 210, each contact finger 120 is deflected outward into the interior surface of the tubular center conductor 210. At the contact finger base 128, the contact between the contact fingers 120 and the tubular center conductor 210 is maintained by pressure from the support section 138 of the core insert 132.

Deflection of each contact finger 120 can also establish contact between each contact finger 120 and the tubular center conductor 210 at the contact finger tip 126, as well as over the length of each contact finger 120 between the contact finger base 128 and the contact finger tip 126. The raised outer diameter 158 of the guided insert 142, being inserted to a position at or near the contact finger tip 126, presses the contact finger tip 126 radially outward to maintain the contact between the contact finger tip 126 and the tubular center conductor 210, to establish and maintain contact between the contact finger tip 126 and the tubular center conductor 210. The area of contact between the contact fingers 120 and the tubular center conductor 210, which results from radially outward pressure at two axial locations along the contact fingers 120 (e.g., the support section 138 and the raised outer diameter 158), is greater than the area of contact from only one point location as known in the prior art. The support section 138 and the raised outer diameter 158 can be positioned so that in the second position of interference, the support section 138 and the raised outer diameter 158 can be closer together, farther apart, or nearer or farther from the contact finger tip 126 or the contact finger base 128. The support section 138 and the raised outer diameter 158 might thusly be relocated axially in the modification of the contact assembly 102 to operate with various connector types and sizes, as well as various coaxial connector types and sizes, and/or to increase contact area and electrical performance and electrical integrity.

Making contact between the contact fingers 120 and the tubular center conductor 210 close to, or at the closest point to the end 212 of the tubular center conductor 210 can also increase the electrical performance of an electrical connector to which the contact assembly 102 and hard line coaxial cable 200 are attached. Electrical and/or electromagnetic signals that travel to the end 212 of the tubular center conductor 210 and then bounce or deflect back are reduced or prevented. Interference is therefore dramatically reduced or prevented by good contact with the tubular center conductor 210 at the contact finger base 128, where the end 212 of the tubular center conductor 10 can be positioned in the second position of interference. The reduction in interference and improvement in signal conduction can allow for greater bandwidth to be passed through the connector assembly 300, which is an important concern for extending the viability of coaxial cable in the future.

The contact pressure between the contact fingers 120 and the tubular center conductor 210 that is provided by the support section 138 and the raised outer diameter 158 increases the moving force required to displace the contact assembly 102 within the tubular center conductor 210, the increased moving force being greater than the relatively low moving force described above in relation to the first position of clearance. This increased moving force helps secure the contact assembly 102 in the second position of interference.

The expanding ability of the contact fingers 120 accommodates use of the contact assembly 102 with coaxial cables categorized as the same size and type but having a tubular center conductor 210 ranging in actual dimensions. One noted problem within the coaxial cable industry is that the tubular center conductors 210 of coaxial cables 200 may be categorized as the same size and type, but the dimensions can vary dramatically from part-to-part or manufacturer-to-manufacturer. For example, size variations may result from tolerance ranges, different manufacturers, different manufacturing processes, and physical manipulation (e.g., the tubular center conductor 210 can be bent out of its regular cylindrical shape). The expanding nature of the contact fingers 120 overcomes these noted problems and can accommodate these size variations and can make good electrical contact in each case. Because the contact fingers 120 can flex and expand radially along the span of the contact fingers 120, the contact fingers can conform to irregularities in the tubular center conductor 210 to make good contact between the fingers and the inside surface of the tubular center conductor 210. With a corrugated tubular center conductor 210, the more regular radially outward pressure of the contact fingers 120 results in a greater and more regular contact area as well.

The connectors and connector components described are exemplary to illustrate how the contact assembly 102 can be moved from the first position of clearance to the second position of interference during attachment and securement of the connector assembly 300 to the coaxial cable 200. Other connectors can also be used in conjunction with the contact assembly 102. For example, the mechanism by which the connector assembly 300 is secured to the coaxial cable 200 can vary, such as by screwing together the body 310 and the cap 320, or by compressing a compression sleeve extending from the rearward end of a single body that houses all the internal components. As another example, a male or female version of the contact assembly 102 is conceived, and the corresponding differences in connectors 300 are also conceived.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

A small sample of systems methods and apparatus that are described herein is as follows:

A method for installing a coaxial cable to a port connector, the method comprising the steps of:

providing a coaxial cable comprising a tubular center conductor, a dielectric layer disposed concentrically around the center conductor, an outer conductor disposed concentrically around the dielectric layer, and an outer jacket disposed concentrically around the outer conductor;

providing a contact assembly comprising a contact pin, a core insert, and a guided insert; the contact pin comprising circumferentially spaced contact fingers defining a first internal cavity, and further comprising a central bore extending from the first internal cavity into an intermediate segment; the core insert having a support section comprising a raised outer diameter; the guided insert comprising a body having a proximal end, an opposing distal end, and defining a central cavity, the central cavity having an inner diameter smaller than the diameter of the core insert support section, the distal end comprising a plurality of insert fingers;

assembling the contact assembly to a first position of clearance by inserting a distal end of the core insert into the central bore of the contact pin and inserting the guided insert fingers into the first internal cavity of the contact pin;

inserting the contact assembly into the tubular center conductor of the coaxial cable;

advancing the contact assembly to a second position of interference by advancing the coaxial cable towards the port connector; and contacting an inner surface of the tubular center conductor with the contact pin fingers at a plurality of axial locations.

The method further wherein the step of contacting the inner surface of the center conductor with the contact pin fingers comprises radially expanding the guided insert fingers over the support section of the core insert, thereby radially expanding the contact pin fingers into the inner surface of the center conductor.

The method further wherein one of the plurality of axial contact locations is defined by the axial location of the support section of the core insert.

The method further wherein the step of contacting the inner surface of the center conductor with the contact pin fingers comprises radially expanding the contact pin fingers over a raised outer diameter on the proximal end of the guided insert.

The method further wherein one of the plurality of axial contact locations is defined by the axial location of the contact pin finger tip.

The method further wherein the step of advancing the coaxial cable towards the port connector includes advancing a cap, the cap being coupled to the coaxial cable by a clamp conforming to the coaxial cable outer conductor.

The method further wherein the guided insert finger further includes a tab extending radially outward therefrom, the tab configured to engage a corresponding contact slot on the contact pin, and the step of advancing the coaxial cable towards the port connector includes advancing the guided insert over the support section of the core insert by coupling the tab to the clamp.

The method further wherein the tab is coupled to the clamp through a mandrel.

What is claimed is:

1. A contact assembly for connecting a cable connector to a tubular center conductor of a coaxial cable, the contact assembly comprising:

a contact pin comprising a proximal end, an opposing distal end, and an intermediate segment therebetween, the pin defining a first internal cavity on the proximal end, the first internal cavity having an inner diameter, the contact pin further comprising a central bore extending from the first internal cavity into the intermediate segment;

a core insert comprising a proximal end, an opposing distal end, and a support section therebetween, the support section comprising an axial section having a diameter greater than the distal end, the distal end configured for coupling with the central bore of the contact pin; and a guided insert comprising a body having a proximal end, an opposing distal end, and defining a central cavity at least on the distal end, the central cavity having an inner diameter smaller than the diameter of the core insert support section.

2. The contact assembly of claim 1, wherein the guided insert further comprises a raised outer diameter, the outer diameter being greater than the inner diameter of the first internal cavity of the contact pin.

3. The contact assembly of claim 2, wherein the raised outer diameter is positioned on the proximal end of the guided insert.

4. The contact assembly of claim 1, wherein the contact pin further comprises circumferentially spaced contact fingers on the proximal end, the contact fingers having a tip, a base, and defining a plurality of contact slots therebetween.

5. The contact assembly of claim 4, wherein each contact finger narrows in width at the base.

6. The contact assembly of claim 1, wherein the distal end of the guided insert comprises a plurality of insert fingers defining insert slots therebetween.

7. The contact assembly of claim 6, wherein at least one guided insert finger includes a tab extending radially outward therefrom, the tab configured to engage the corresponding contact slot on the contact pin.

8. The contact assembly of claim 6, wherein one insert finger on the guided insert is sized wider than the contact slot on the contact pin.

9. The contact assembly of claim 1, further comprising a retainer to retain the guided insert in a first position of clearance until it is desired to move the guided insert into a second position of interference.

10. The contact assembly of claim 9, wherein the retainer is a nub.

11. The contact assembly of claim 10, wherein the nub is positioned on the contact finger of the contact pin.

12. A connector for connecting to a coaxial cable, the coaxial cable comprising a tubular center conductor, a dielectric layer disposed concentrically around the center conductor, an outer conductor disposed concentrically around the dielectric layer, and an outer jacket disposed concentrically around the outer conductor, the connector comprising:

a body configured to mate with a port connector;

an insulator ring concentrically disposed within the body;

an electrically conductive contact pin disposed within the insulator ring, the contact pin comprising a proximal end, an opposing distal end, and an intermediate segment therebetween, the proximal end comprising circumferentially spaced contact fingers having a tip and a base, the contact fingers defining a plurality of contact slots therebetween and further defining a first internal cavity having an inner diameter, the contact pin further comprising a central bore extending from the first internal cavity into the intermediate segment;

a core insert comprising a proximal end, an opposing distal end coupled with the central bore of the contact pin, and a support section between the proximal and distal ends, the support section comprising an axial section having a diameter greater than the distal end;

a guided insert comprising a body having a proximal end, an opposing distal end, and defining a central cavity at least on the distal end, the central cavity having an inner diameter smaller than the diameter of the core insert support section, the distal end comprising a plurality of insert fingers defining insert slots therebetween, an inner surface of the insert fingers in contact with the support section of the core insert, an outer surface of the insert fingers in contact with the an inner surface of the contact pin fingers; and a cap sealingly coupled to the body and the coaxial cable jacket;

the contact pin fingers in electrical contact with an inner surface of the tubular center conductor at a plurality of axial locations.

13. The coaxial cable connector of claim 12, wherein the contact pin further comprises a shoulder at the transition from the intermediate segment to the distal end, the shoulder being in contact with a radial face of the insulator ring.

14. The coaxial cable connector of claim 12, wherein at least one insert finger of the guided insert further comprises a tab extending radially outward therefrom, the tab engaged with the corresponding contact slot on the contact pin.

15. The coaxial cable connector of claim 14, further comprising a mandrel coupled to the cap, configured to engage the tabs on the guided insert.

16. The coaxial cable connector of claim 15, wherein the mandrel is disposed within the outer conductor of the coaxial cable.

17. The coaxial cable connector of claim 15, further comprising a clamp disposed between the cap and the mandrel, the clamp conforming to the coaxial cable outer conductor.

* * * * *